US005547802A

United States Patent [19]

Kawase et al.

[11] Patent Number: 5,547,802

[45] Date of Patent: Aug. 20, 1996

[54] IMAGE FORMATION MATERIALS AND IMAGE FADING PREVENTION METHOD

[75] Inventors: Hiromitsu Kawase, Mishima; Yoshikazu Kaneko, Numazu; Shoji Maruyama, Yokohama, all of Japan

[73] Assignee: Ricoh Company, Ltd., Tokyo, Japan

[21] Appl. No.: 331,915

[22] Filed: Oct. 31, 1994

[30] Foreign Application Priority Data

Nov. 2, 1993 [JP] Japan ..... 5-297448
Oct. 24, 1994 [JP] Japan ..... 6-284362

[51] Int. Cl.[6] ..... G03G 9/097

[52] U.S. Cl. ..... 430/110

[58] Field of Search ..... 430/106, 106.6, 430/109, 110

[56] References Cited

U.S. PATENT DOCUMENTS 4,711,832 12/1987 Gruenbaum et al. ..... 430/106
5,079,123 1/1992 Nanya ..... 430/106.6
5,085,965 2/1992 Nanya ..... 430/109
5,102,766 4/1992 Nanya ..... 430/110
5,368,972 11/1994 Yamashita ..... 430/137
5,407,774 4/1995 Matsushima et al. ..... 430/115
5,409,794 4/1995 Ong ..... 430/110

*Primary Examiner*—John Goodrow
*Attorney, Agent, or Firm*—Cooper & Dunham LLP

[57] ABSTRACT

An image formation material for forming images including color images, such as a toner or developer for use in image formation methods such as electrophotography, electrostatic recording, and in an ink jet printing, includes a binder resin, a dye, and a quencher for preventing the deterioration of the dye; and a method of preventing the fading of images formed by the above image formation methods can be carried out by use of this image formation material.

8 Claims, 1 Drawing Sheet

FIGURE
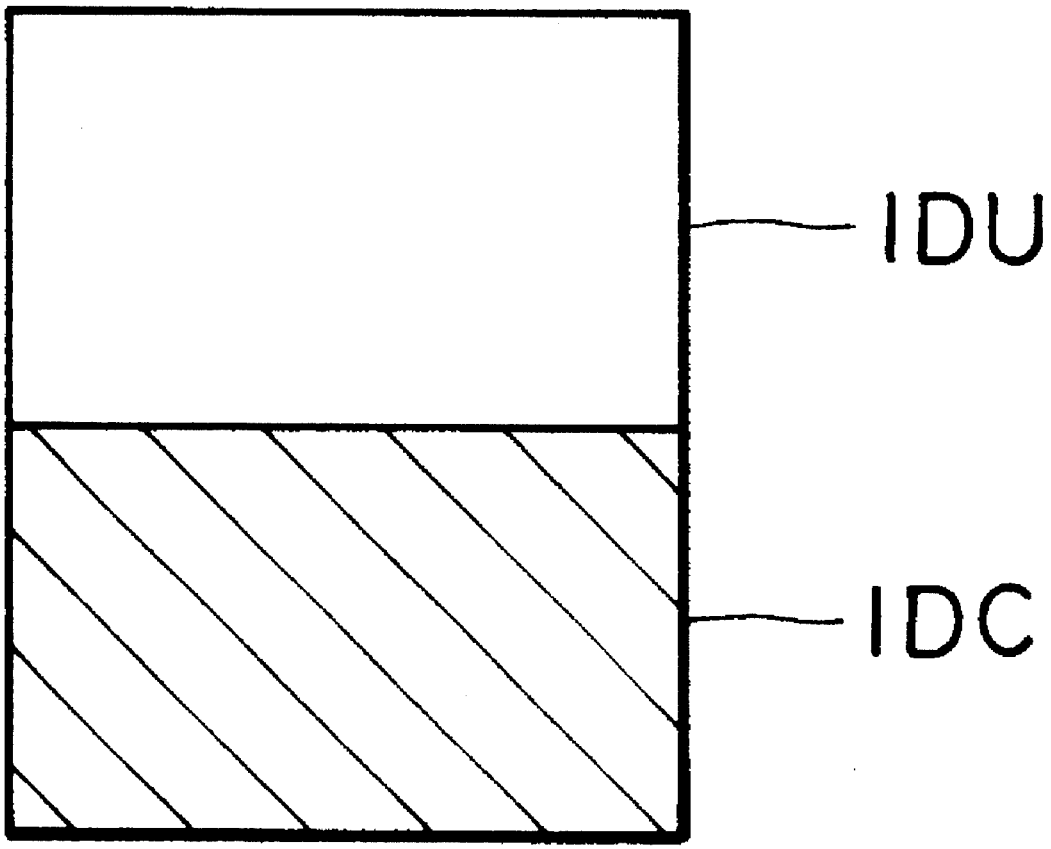

IMAGE FORMATION MATERIALS AND IMAGE FADING PREVENTION METHOD

BACKGROUND OF THE INVENTION

1. Field of the Invention

The present invention relates to image formation materials for use in electrophotography, electrostatic recording and ink jet printing method, and an image fading prevention method by use of the image formation materials, and more particularly to a toner or developer for use in electrostatic development and a color image fading prevention method using the toner or developer.

2. Discussion of Background

In accordance with recent development of office automation (OA), excellent image formation method, particularly color image formation method, is demanded.

As image formation methods, for instance, electrophotography, electrostatic recording method, and ink jet printing method are currently employed.

For example, in electrophotography, latent electrostatic images are formed on a photoconductor which comprises a photoconductive material, the latent electrostatic images are then developed to toner images by a developer, and when necessary, the toner images are transferred to a transfer sheet or the like, and fixed thereto by the application of heat or pressure thereto, whereby visible images are formed thereon.

Multicolor images are obtained by exposing such a photoconductor to light images through a color separation filter, or exposing the photoconductor to images read by a scanner for writing the images in the photoconductor, to form latent electrostatic images. The thus formed latent electrostatic images are developed by use of color developers of yellow, magenta, cyan and black, and yellow, magenta, cyan and black toner images are superimposed, whereby multicolor images can be obtained.

Conventional toners for use in electrophotography are produced by kneading a thermoplastic resin, a pigment, and a charge controlling agent, and pulverizing the kneaded mixture. In the thus produced toner are dispersed particles of the pigment, and therefore light scattering is caused by the dispersed pigment particles, so that the transparency of the toner is lowered. Therefore, when color images are formed by use of a plurality of such toners, the color reproduction thereof is poor. Color images formed by such toners, when produced on a transparent sheet for overhead projector (OHP), have the shortcoming that projected images are dark and the chroma thereof is low.

In order to improve the transparency of such color images, it has been proposed that C.I. Solvent Blue 35, indophenol, and anthraguinone dye be employed instead of pigments, as disclosed In Japanese Laid-Open Patent Applications 62-273570, 64-29855, and 1-284865. Toners comprising such dyes, however, have the shortcoming that the light resistance or fading resistance thereof is so poor that they cannot be used in practice.

In order to improve the light resistance or fading resistance of such toners, it has been proposed to contain an ultraviolet absorbing agent or an anti-oxidizing agent in such toners as disclosed in Japanese Laid-Open Patent Applications 52-12838, 53-370925, 60-93453, 1-172973, 1-172974, 1-172975, 1-172976, 2-264964, 2-264965, and 2-264966.

However, toners containing an ultraviolet absorbing agent or an anti-oxidizing agent are not capable of exhibiting a sufficient fading resistance for use in practice, while maintaining satisfactory spectral reflection characteristics. Image formation materials for forming color images by ink jet printing method and other methods also have the same problems as mentioned above.

SUMMARY OF THE INVENTION

It is therefore a first object of the present invention to provide an image formation material which has excellent transparency and excellent anti-fading performance for use in electrophotography, electrostatic recording method and ink jet printing method.

A second object of the present invention is to provide a method of preventing fading of images.

The first object of the present invention can be achieved by an image formation material comprising a binder resin, a dye, and a quencher.

The second object of the present invention can be achieved by an image formation method comprising the step of coating a quencher on the surface of images formed by an image formation material which comprises a binder resin and a dye.

As the quencher for use in the present invention, at least one compound selected from the following compounds of formulae (I) to (IV) can be employed:

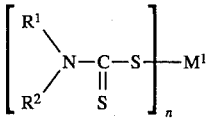

(I)

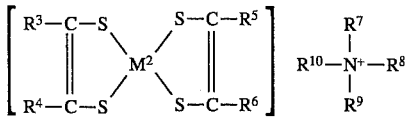

(II)

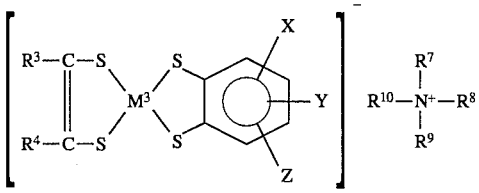

(III)

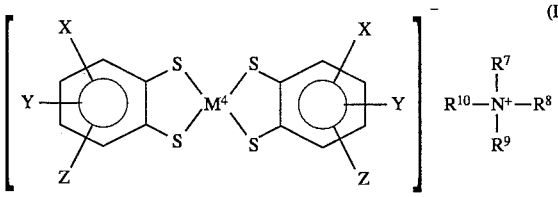

(IV)

wherein $R^1$ and $R^2$ each is independently an alkyl group having 1 to 18 carbon atoms, phenyl group, benzyl group or an aryl group; $M^1$ is a bivalent or trivalent metal; n is an integer of 2 or 3; $R^3$, $R^4$, $R^5$, and $R^6$ each is independently cyano group, phenyl group, or a phenyl group substituted with an alkyl group, an alkoxyl group, or a halogen atom; X, Y and Z each is independently an alkyl group having 1 to 4 carbon atoms, a halogen atom, a hydrogen atom, or an alkoxyl group; $R^7$, $R^8$, $R^9$, and $R^{10}$ each is an alkyl group having 1 to 18 carbon atoms; $M^2$, $M^3$ and $M^4$ each is independently nickel, copper, cobalt, palladium or vanadium.

As the quencher for use In the present invention, the following compound (V) can also be employed, which is dyeable:

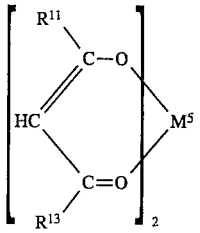

(V)

wherein $M^5$ is selected from the group consisting of nickel, copper, cobalt, palladium and vanadium; and $R^{11}$ and $R^{12}$ each is independently a lower alkyl group or $—C(R^{13})_3$, in which $R^{13}$ is a halogen atom.

In the above compounds of formulae (I) to (V), compounds with each of $M^1$ to $M^5$ thereof being nickel are preferable for use in the present invention.

The quencher for use in the present invention is a compound which is capable of deactivating an excited compound to a ground state thereof. The excited compound is a compound which has generated a singlet oxygen by a self-sensitization effect of a dye. The quencher is capable of deactivating oxygen molecules in a singlet state to the oxygen molecules in the ground state, so that the deterioration of the dye that would otherwise be coused by the singlet oxygen can be prevented.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

FIG. 1 is a schematic plane view of a test sample for the measurement of the color image fading ratio thereof.

DETAILED DESCRIPTION OF THE PREFERRED EMBODIMENTS

The image formation material of the present invention comprises a binder resin, a dye and a quencher.

As the binder resin for use in the present invention, conventional thermoplastic resins can be employed.

Specific examples of such thermoplastic resins are polymers and copolymers prepared from the following monomers, and mixtures of such polymers and copolymers; styrene, parachlorostyrene, vinyl toluene, vinyl chloride, vinyl acetate, vinyl propionate, methyl (metha)acrylate, ethyl (metha)acrylate, propyl (metha)acrylate, n-butyl (metha)acrylate, isobutyl (metha)acrylate, dodecyl (metha)acrylate, 2-ethylhexyl (metha)acrylate, lauryl (metha)acrylate, 2-hydroxyethyl (metha)acrylate, hydroxypropyl (metha)acrylate, 2-chloroethyl (metha)acrylate, (metha)acrylonitrile, (metha)acrylamide, (metha)acrylic acid, vinyl methyl ether, vinyl ethyl ether, vinyl isobutyl ether, vinyl methyl ketone, N-vinylpyrrolidone, N-vinylpyridine and butadiene.

In addition, polyester, polyurethane, polyamide, epoxy resin, phenol resin, aliphatic or aliphatic-based hydrocarbon resin, and aromatic petroleum resin can be employed individually or in combination.

Particularly preferable resins are such resins that are prepared by dispersion polymerization which will be described later.

As the dye for use in the present invention, oil-soluble dyes and disperse dyes are preferably employed.

Specific examples of oil-soluble dyes are C.I. Solvent Yellow 6, 9, 17, 31, 35, 58, 100, 102, 103; C.I. Solvent Orange 2, 7, 13, 14, 66; C.I. Solvent Red 5, 16, 17, 18, 19, 22, 23, 143, 145, 146, 149, 150, 151, 157, 158; C.I. Solvent violet 31, 32, 33, 37; C.I. Solvent Blue 22, 53, 78, 83, 84, 85, 86, 91, 94, 95, 104; C.I. Solvent Green 24, 25; C.I. Solvent Brown. 3; and Solvent Black 3.

Specific examples of disperse dyes are C.I. Disperse Yellow 3, 7, 33, 42, 64, 82, 237; C.I. Disperse Orange 3, 13, 29, 30; C.I. Disperse Red 1, 17, 50, 54, 56, 60, 65, 72, 73, 88, 91, 92, 110, 135, 145, 146, 154, 167, 177, 207, 258, 283; C.I. Disperse Violet 1, 4, 26, 28, 35, 38, 43, 77; C.I. Disperse Blue 7, 56, 60, 73, 79, 81, 91, 94, 96, 102, 106, 128, 139, 146, 148, 149, 165, 183, 186, 187, 197, 201, 205, 207, 214, 257, 266, 268, 291, 341, 354, 358; and C.I. Disperse Brown 1.

When any of indoaniline dyes of formula (VI) or formula (VII) shown in TABLE 1 is employed for a cyan toner for electrostatic development, cyan images with excellent transparency suitable for overhead projectors can be obtained.

Specific examples of such indoaniline dyes are shown in TABLE 1, but dyes for the cyan toner are not limited to these examples. These indoaniline dyes can also be employed in combination.

The amount of the dye, for instance, when used in the toner for electrostatic development, differs depending upon the charge quantity of the toner particles and the particle size thereof, but is generally in a range of about 0.5 to 10 wt. %. The dye may be kneaded and pulverized together with a resin, but it is preferable to use a resin colored with the dye for increasing the transparency of the toner, and for improving the reproduction of intermediate colors and projected image quality when projected by overhead projectors.

TABLE 1

| Formula | Compound No. | R | X | Y |
|---|---|---|---|---|
| 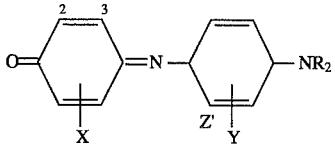 | IA-1 | $CH_3$ | H | H |
| | IA-2 | $CH_3$ | 2-$CH_3$ | H |
| | IA-3 | $CH_3$ | 2-$OCH_3$ | 2'-$CH_3$ |
| | IA-4 | $CH_3$ | 3-Cl | H |
| | IA-5 | $C_2H_5$ | 2-$OCH_3$ | H |
| | IA-6 | $C_2H_5$ | 3-F | 2'-$C_2H_5$ |
| | IA-7 | $C_2H_5$ | 3-$NH_2$ | 2'-$C_2H_5$ |
| | IA-8 | $C_2H_5$ | 3-F | |

Formula (VI)

TABLE 1-continued

| Formula | Compound No. | R | X | Y |
|---|---|---|---|---|
| 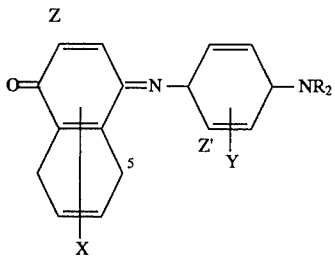 Formula (VII) | IA-9 | $CH_3$ | H | H |
| | IA-10 | $CH_3$ | 2-Br | H |
| | IA-11 | $CH_3$ | 5-OH | 2'-$CH_3$ |
| | IA-12 | $CH_3$ | 5-$NH_2$ | 2'-$CH_3$ |
| | IA-13 | $C_2H_5$ | 2-Br | H |
| | IA-14 | $C_2H_5$ | 5-OH | H |
| | IA-15 | $C_2H_5$ | 5-$NH_2$ | 2'-$C_2H_5$ |
| | IA-16 | $C_2H_5$ | 5-OH | 2'-$C_2H_5$ |

According to the present invention, the transparency and fading resistance of the image formation material are significantly improved by containing a quencher therein.

Specific examples of the quencher for use in the present invention are β-carotene, DABCO [1,4-diazobicyclo(2,2,2)-octane], α-tochopherol, triphenylamine, nickel p-toluenesulfonate, and nickel complexes shown in the following TABLE 2 and TABLE 3:

TABLE 2

| No. | Formula |
|---|---|
| QN-1 | 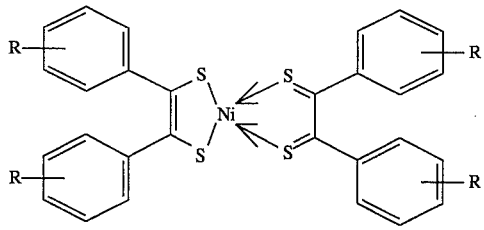 |
| QNi-2 | 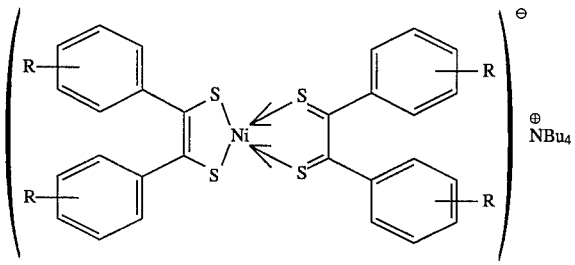 |
| QNi-3 | 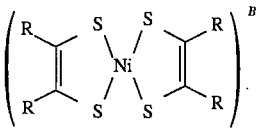 |
| QNi-4 | 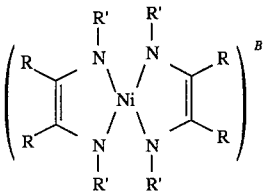 |
| QNi-5 | 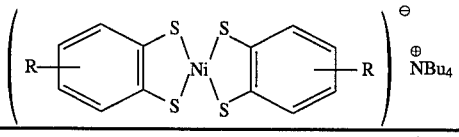 |

In TABLE 2, R is a hydrogen atom, a halogen atom, or an alkoxyl group having 1 to 5 carbon atoms; and R' is a hydrogen atom, or an alkyl group.
TABLE 3
| No. | Formula | |
|---|---|---|
| QNi-6 | 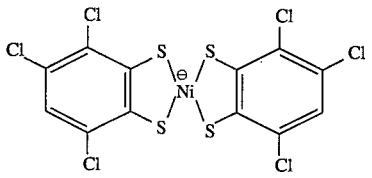 | $N^{\oplus}$-($tBu_4$) |
| QNi-7 | 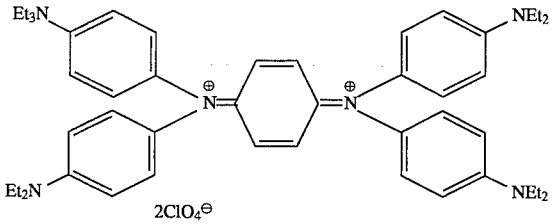 | ($NEt_2$) |
| QNi-8 | 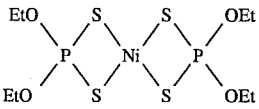 | |
| QNi-9 | 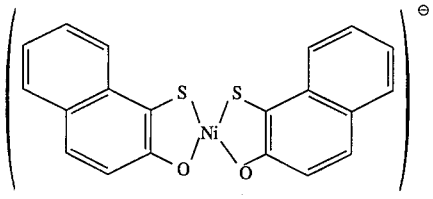 | $N^{\ominus}$-$tBu_4$) |
| QNi-10 | $Ni(CO)_2[P(C_2H_5)_3]_2$ | $C_6H_5$ |
| QNi-11 | $NiBr[P(C_6H_5)_3]_2$ | |
Representative examples of compounds of formulae (I) to (V) are shown in the following TABLE 4:

TABLE 4
| No. | Formula |
|---|---|
| Q-21 | 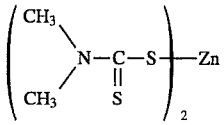 |
| Q-22 | 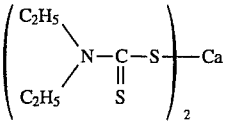 |
| Q-23 | 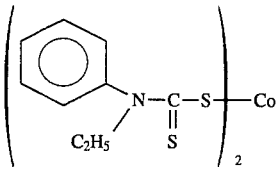 |
| Q-24 | 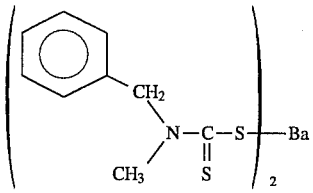 |
| Q-25 | 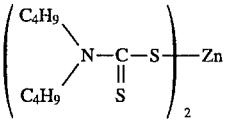 |
| Q-26 | 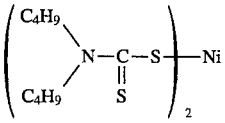 |
| Q-27 | 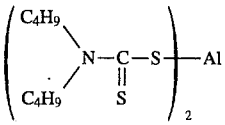 |
| Q-28 | 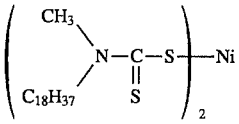 |
| Q-29 | 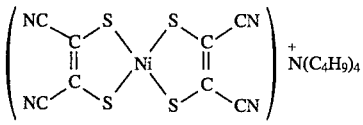 |
| Q-30 | 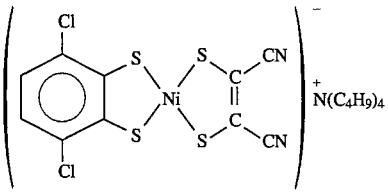 |

TABLE 4-continued
| No. | Formula |
|---|---|
| Q-31 | 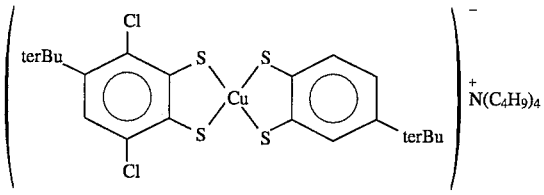 |
| Q-32 | 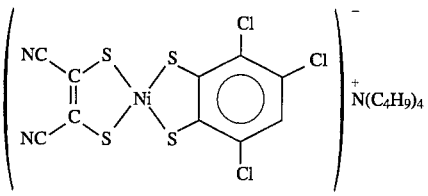 |
| Q-33 | 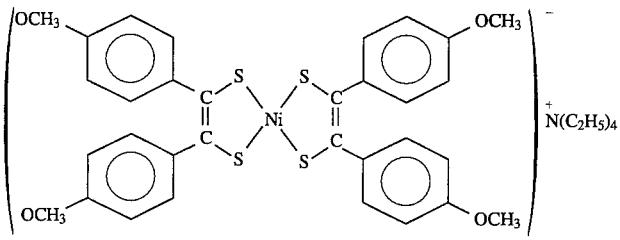 |
| Q-34 | 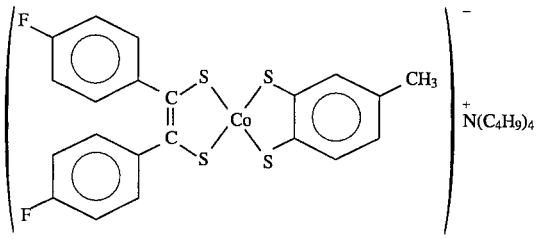 |
| Q-35 | 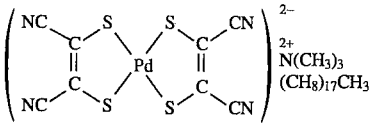 |
| Q-36 | 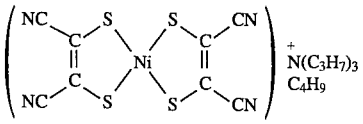 |
| Q-37 | 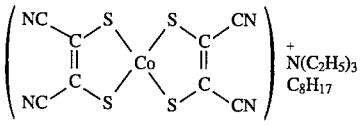 |
| Q-38 | 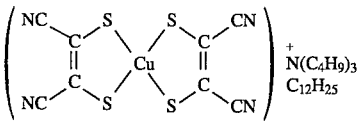 |
| Q-39 | 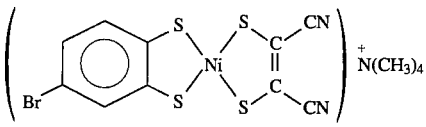 |

TABLE 4-continued
| No. | Formula |
|---|---|
| Q-40 | 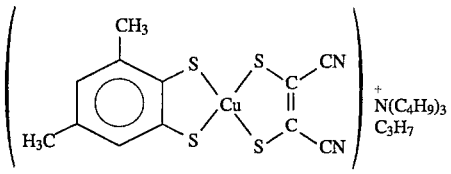 |
| Q-41 | 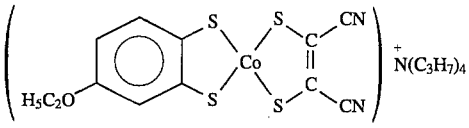 |
| Q-42 | 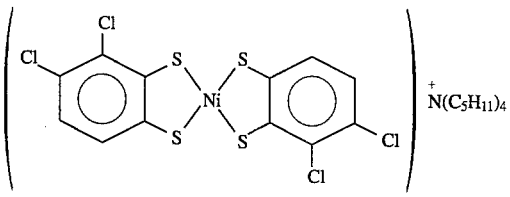 |
| Q-43 | 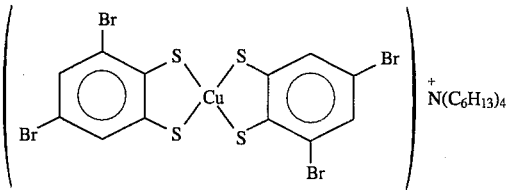 |
| Q-44 | 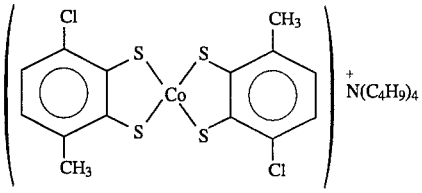 |
| Q-45 | 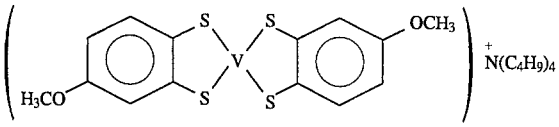 |
| Q-46 | 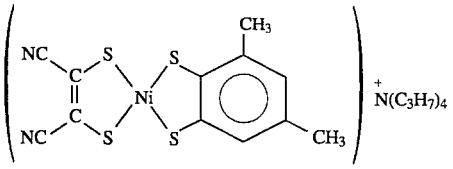 |
| Q-47 | 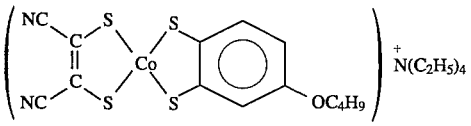 |
| Q-48 | 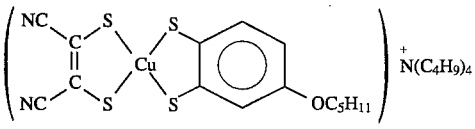 |
| Q-49 | 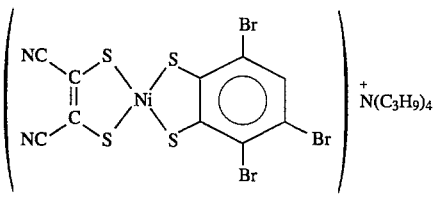 |

TABLE 4-continued

| No. | Formula |
|---|---|
| Q-50 | 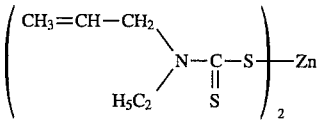 |
| Q-51 | 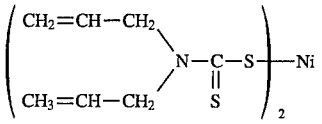 |
| Q-52 | 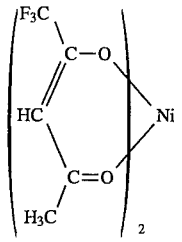 |
| Q-53 | 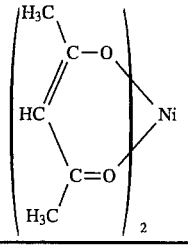 |

The above-mentioned quenchers can be used alone or in combination, when such a quencher is employed by being mixed with a binder resin, it is preferable that the quencher be employed in an amount of 0.01 to 30 parts by weight to 100 parts by weight of a binder resin. When the quencher is employed for use in a color toner for electrostatic development, it is preferable that the quencher be employed in an amount of 0.01 to 5 parts by weight to 100 parts by weight of a binder resin in view of the image fixing performance and transparency of the color toner.

The mechanism of the improvement of the anti-fading performance of color images attained by use of the quencher is considered as follows:

$$D_0 \xrightarrow{\eta\lambda} {}_1D^* \longrightarrow {}_3D^* \longrightarrow D_0 + D_x \quad (1)$$

In the above formula (1), a dye $D_0$ in the ground state absorbs light, so that the dye is excited to ${}_1D^*$, and the complementary color thereof is recognized as a color by the human eyes.

There are the following three deactivation cases: (1) deactivation from high energy state excited to ${}_1D^*$ to the ground state $D_0$ as light (fluorescent light); (2) deactivation from ${}_3D^*$ to light (phosphorescence) through intersystem crossing; and (3) deactivation from high energy states of ${}_1D^*$ and ${}_3D^*$ to the ground state $D_0$ as heat through a nonradiative process.

No decomposition or deterioration of dyes takes place in principle if the deactivation from the high energy excited states (${}_1D^*$ and ${}_3D^*$) to light or heat takes place with a probability of 100% so that the $D_0$ state is reached. However, in the case where the dye itself is decomposed to reach the state $D_X$ by high energy waves with short wavelengths such as UVA (400 to 315 nm) and UVB (315 to 280 nm), such decomposition becomes one of factors to lower the anti-fading performance of color images.

The deterioration of the dye during the above-mentioned step can be prevented by preventing UVA and UVB waves from reaching the molecules of the dye by the addition of an ultraviolet absorbing agent to color images. In this case, the ultraviolet (UV) absorbing agent itself has high nonradiative energy deactivation efficiency from the excited singlet state ${}_1UV$ to the ground state $UV_0$, so that the dye is hardly decomposed. Thus, the ultraviolet (UV) absorbing agent contributes to the prevention of the deterioration of the dye.

However, the deterioration of the dye is not always caused only by ultraviolet. In particular, it has been found that many dyes such as yellow, magenta and cyan dyes for use in the formation of color images are caused to deteriorate largely by oxidation by self-sensitizing singlet oxygen.

This deterioration mechanism is as follows:

$${}_3D^* + {}^3O_2 \rightarrow D_0 + {}^1O_2 \quad (2)$$

It is well known that the atmospheric oxygen is in a triplet state even if the oxygen molecule is at the ground state. The dye (${}_3D^*$) is deactivated by the oxygen molecule (${}^3O_2$), so that the dye (${}_3D$) is deactivated to the ground state $D_0$. However, the oxygen molecule is in an excited singlet state as shown in the above formula (2). This singlet oxygen (${}^1O_2$) is referred to as the singlet oxygen self-sensitized by the dye. The deterioration of the dye is caused by the dye being oxidized by this ${}^1O_2$ as shown in the following formula (3):

$$D_0+{}^1O_2 \rightarrow \text{Oxidized Product} \quad (3)$$

The quencher (Q) for use in the present invention hinders the generation of excited singlet oxygen molecules via the steps of the following formulae (4) and (5), so that the formation of the oxidized product of the dye as shown in the above formula (3) is hindered and the anti-fading performance of color images can be improved.

$$^1O_2+Q \rightarrow QO_2 \quad (4)$$

$$^1O_2+Q \rightarrow {}^3O_2+Q \quad (5)$$

A preferable quencher for use in the present invention is such a quencher that physically deactivates singlet oxygen to triplet oxygen as shown in the above formula (5). According to the present invention, it has been discovered that a quencher compound which is most preferable for deactivating the singlet oxygen which is self-sensitized by indoaniline dye is such a compound that contains a nickel atom in the structure thereof.

It is preferable that a quencher for use in a color toner for electrostatic development be a colorless compound. In particular, nickel p-toluene sulfonate is colorless and is capable of improving the light resistance of a color toner comprising a dye. In addition, (Q-52) given in TABLE 4 has a molecular absorption coefficient $\epsilon$ which is about 1/50 the molecular absorption coefficient $\epsilon$ of indoaniline dye, and does not have any substantial effect on the tone of color toner.

Preferable methods of employing such a quencher in a color toner or developer for electrostatic recording will now be explained.

The above methods of employing a quencher can be roughly classified into methods of containing a quencher in toner, and methods of adding a quencher to the developer.

[Methods of Containing a Quencher in Toner]

1. Containing a quencher in a kneaded mixture of a binder resin, a coloring agent and other components for toner when the mixture is fused and kneaded.

2. Containing a quencher in binder resin particles which are prepared and dyed, for example, by dispersion polymerization, suspension polymerization.

3. When suspension polymerization is employed for the formation of toner particles, a quencher may be dissolved, or finely-divided particles of a quencher may be dispersed in a monomer liquid before the initiation of the suspension polymerization, followed by carrying out the polymerization.

[Methods of Adding a Quencher to Developer]

Finely-divided quencher particles are added to toner particles in the same manner as in the case of addition of additives such as silica particles.

Alternatively, a quencher may be coated on the surface of color images, whereby the anti-fading performance or light resistance of the color images can be improved. A specific method of carrying out this coating will be carried out by applying a quencher-containing transparent thin film to color images.

A most preferable fading prevention method for color images formed by an electrostatic development method is a method which is carried out by dissolving a quencher or dispersing finely-divided quencher particles in a silicone oil which is coated on the surface of a thermal image fixing roller employed in a copying machine. By this method, the quencher can be most efficiently coated on the surface of color images when they are fixed, and the quencher can be caused to penetrate into the fixed color images to some extent, so that the quencher can be introduced into color images in the same manner as in the cases of containing the quencher in the toner or adding the quencher to the developer as mentioned previously.

Dissolving the quencher directly in silicone oil cannot always be carried out successfully when the solubility or dispersibility of the quencher in silicone oil is poor. Therefore it is preferable to disperse the quencher in the form of finely-divided particles in silicone oil by solvent substitution. In this case, the quencher can be dissolved in an amount of about 20 parts by weight to 100 parts by weight of silicone oil. The higher the solubility of the quencher in silicone oil, the more preferable. However, in view of the solubility limit of the quencher in silicone oil and the color produced by the toner, it is preferable that the quencher be dissolved in an amount of 0.1 to 5 parts by weight to 100 parts by weight of silicone oil.

When necessary, a charge controlling agent and/or a releasing agent may be added to the toner according to the present invention.

For instance, as charge controlling agents for a negatively chargeable toner, metal chelates of an alkyl salicylic acid and naphthoic acid, and fluorine-containing compounds as disclosed in Japanese Laid-Open Patent Applications 55-76353 and 3-21877 can be employed; and as charge controlling agents for a positively chargeable toner, quaternary ammonium salts, and alkyl metal oxides, for instance, as disclosed in Japanese Laid-Open Patent Application 56-164350, can be employed.

As releasing agents, low-molecular-weight polyolefins such as low-molecular-weight polyethylene, low-molecular-weight polypropylene, and oxidized polyethylene; natural waxes such as bees wax, carnauba wax, and montan wax; higher fatty acids such as stearic acid, palmitic acid and myristic acid; metal salts of such higher fatty acids; and amides of such higher fatty acids can be employed. Such releasing agents can be caused to efficiently exhibit the effects thereof by providing a releasing agent layer on the surface of toner particles.

When a carrier is employed together with the toner, conventional carriers can be employed. For example, metals such as surface-oxidized or unoxidized iron, nickel, copper, cobalt, manganese and chromium, alloys of these metals, oxides of these metals, and ferrites comprising any of these metals can be employed as such carriers. Carriers with the surface thereof being coated with a resin can also be employed.

Furthermore, a fluidity improving agent such as colloidal silica may also be added in an amount of about 0.01 to 3 parts by weight to 100 parts by weight of the toner of the present invention.

In order to obtain images with excellent dot reproduction and sharpness, it is preferable that the volume mean diameter (Dv) of the toner particles be in the range of 3 to 9 μm, and that the ratio of the volume mean diameter (Dv) to the number-average particle diameter (Dp), that is, the ratio (Dv/Dp), be in a range of 1.00 to 1.15.

Evaluation of the fading of color images formed by the image formation material according to the present invention will now be explained.

Color image test samples for this evaluation were prepared by a copying machine with a color toner for electrostatic development being deposited in an amount of 1.0 to 1.5 mg/cm$^2$.

The evaluation of the anti-fading performance was performed by use of a commercially available xenon tester (Trademark "XW-150" made by Shimadzu Corporation), with the test sample being exposed to xenon light for 5 hours, and the fading ratio (%) of the colored images in the test sample being calculated as follows by measuring the image density of the exposed color images by a Macbeth densitometer (Trademark "Macbeth RD-914"):

The measurement of the fading ratio of the above-mentioned test sample was conducted by use of a test sample with a size of about 1 cm×10 cm as illustrated in FIG. 1. As illustrated in FIG. 1, the test sample was exposed to xenon light by use of the xenon tester for 5 hours, with a lower half portion (about 5 cm portion) of the test sample being covered with an aluminum plate, and an upper half portion being exposed to xenon light without being covered with anything.

After this 5-hour exposure, the image density (IDU) of the uncovered portion and the image density (IDC) of the covered portion of the test sample were measured by the Macbeth densitometer, and the fading ratio thereof was calculated from the following formula (A):

$$\text{Fading ratio}=[1-(IDU)/(IDC)]\times 100 \qquad (A)$$

The features of this invention will become apparent in the course of the following description of exemplary embodiments, which are given for illustration of the invention and are not intended to be limiting thereof.

EXAMPLE 1

Polyester resin, a yellow, magenta, cyan or black dye and a charge controlling agent were mixed in accordance with the formulation shown in TABLE 5, and the mixture was fused and kneaded with application of heat thereto, and was then cooled, whereby a toner lump was obtained.

This toner lump was roughly crushed in a hammer mill, pulverized in a jet air mill, and was classified, whereby a yellow toner No. 1, a magenta toner No. 1, a cyan toner No. 1, and a black toner No. 1 for electrostatic development of the present invention, with the particle diameter of these toner being adjusted in a range of 4 to 9 μm, were prepared.

In the preparation of these color toners, the following dyes were respectively employed in the yellow toner, magenta toner, cyan toner and black toner:

Yellow toner: Oil Yellow 3G (made by Orient Chemical Industries, Ltd.)

Magenta toner: SOT RED 3 (made by Hodogaya Chemical Co., Ltd.)

Cyan toner: Waxolin Blue PWF (made by Imperial Chemical Industries, Co., Ltd.)

Black toner: Oil Black 860 (made by Orient Chemical Industries, Ltd.) (8 parts by weight) Macrolex Orange (2 parts by weight)

Furthermore, as the charge controlling agent, a commercially available charge controlling agent (Trademark "E-84" made by Orient Chemical Industries, Ltd.) was employed. As quenchers, both β-carotene and DABCO [1,4-diazobicyclo92,2,2)octane] were employed.

TABLE 5

| Formulation | Example 1 | | | |
|---|---|---|---|---|
| | Yellow Toner | Magenta Toner | Cyan Toner | Black Toner |
| Polyester resin | 100 | 100 | 100 | 100 |
| Yellow dye | 5 | — | — | — |
| Magenta dye | — | 3 | — | — |
| Cyan dye | — | — | 3 | — |

TABLE 5-continued

| Formulation | Example 1 | | | |
|---|---|---|---|---|
| | Yellow Toner | Magenta Toner | Cyan Toner | Black Toner |
| Black dye | — | — | — | 5 |
| Charge Controlling Agent | 2 | 2 | 2 | 2 |
| β-carotene | 1 | 1 | 1 | 1 |
| DABCO | 1 | 1 | 2 | 1 |

Comparative Example 1

The procedure for preparation of the yellow toner No. 1, the magenta toner No. 1, the cyan toner No. 1, and the black toner No. 1 prepared in Example 1 was repeated except that the quenchers employed in Example 1 were replaced by ultraviolet absorbing agents, 4-phenylbenzophenone (UV1) and phenyl salicylate (UV2), with the respective formulations as shown in the following TABLE 6, whereby a comparative yellow toner 1, a comparative magenta toner No. 1, a comparative cyan toner No. 1 and a comparative black toner No. 1 were prepared:

TABLE 6

| Formulation | Comparative Example 1 | | | |
|---|---|---|---|---|
| | Yellow Toner | Magenta Toner | Cyan Toner | Black Toner |
| UV1 | — | 2 | 2 | 2 |
| UV2 | 2 | — | 2 | 1 |

Comparative Example 2

The procedure for preparation of the yellow toner No. 1, the magenta toner No. 1, the cyan toner No. 1, and the black toner No. 1 prepared in Example 1 was repeated except that the quenchers employed in Example 1 were eliminated from the respective formulations of the toners, whereby a comparative yellow toner No. 2, a comparative magenta toner No. 2, a comparative cyan toner No. 2 and a comparative black toner No. 2 were prepared.

TABLE 7 shows the results of the fading ratios of color images made by the respective color toners prepared in Example 1 and Comparative Examples 1 and 2.

The results shown in TABLE 7 indicate that the fading ratio of fixed color image samples prepared by toners in Comparative Example 2, which contained neither the quenchers nor the ultraviolet absorbing agents, was largest, and that the anti-fading performance of the toners prepared in Comparative Example 1, which contained the ultraviolet absorbing agents, was slightly better than that of the toners prepared in Comparative Example 2, but the anti-fading performance of the toners prepared in Example 1, which contained the quenchers, was much better than any of the anti-fading performances of the toners prepared in Comparative Examples 1 and 2.

TABLE 7

| | Fading Ratio (%) of Fixed Image Sample | | | |
|---|---|---|---|---|
| | Yellow Toner | Magenta Toner | Cyan Toner | Black Toner |
| Ex. 1 | 32 | 27 | 38 | 19 |
| Comp. Ex. 1 | 40 | 58 | 63 | 38 |
| Comp. Ex. 2 | 58 | 64 | 72 | 54 |

EXAMPLE 2

The following components were placed in a 500 ml four-necked sealable, separable flask, which was immersed in a temperature-constant water chamber:

| | Parts by Weight |
|---|---|
| Methanol | 100 |
| Methylvinyl ether - maleic anhydride copolymer (Trademark "AN-119" made by BASF Japan Ltd.) | 2.5 |

The mixture of the above-mentioned components was starred at 100 rpm with the temperature of the temperature-constant water chamber set at 65° C., to completely dissolve the copolymer in the methanol, whereby a dispersion stabilizer solution was prepared.

250 parts by weight of the dispersion stabilizer solution was transferred into a 500 ml four-necked sealable, separable flask, which was immersed in a temperature-constant water chamber, and the following components were then placed in the flask:

| | Parts by Weight |
|---|---|
| Styrene | 60 |
| Methyl acrylate | 40 |
| Dodecylmercaptan | 0.2 |
| Viscoat 336 (made by Osaka Organic Chemical Industry, Ltd.) $[CH_2{=}CHCO{-}(CH_2CH_2O)_4COCH{=}CH_2]$ | 1.6 |

The oxygen contained in the flask was removed until the concentration of the dissolved oxygen reached 0.1% or less by blowing nitrogen gas through the flask, with the reaction mixture being stirred, and polymerization was carried out with the reaction mixture being stirred at 100 rpm and with the temperature of the water-chamber maintained at 65° C.

For the initiation of this polymerization, 2.25 parts by weight of 2,2-azobis(2,4-dimethylvaleronitrile) were employed as an initiator.

One hour after the initiation of the polymerization, a methanol solution of 2.5 parts by weight of dodecylmercaptan dissolved in 20 parts by weight of methanol was added to the above reaction mixture, and the polymerization was continued for 8 hours and was then terminated.

Water was removed from the temperature-constant water chamber, and the separable flask was cooled to room temperature.

The following monomer composition and 2.4 parts by weight of the above-mentioned initiator were added to the above reaction mixture, and polymerization was continued for 24 hours, whereby dispersed polymer particles with a volume mean diameter of 5.0 μm were obtained:

| | Parts by Weight |
|---|---|
| Styrene | 18 |
| tert-butylacrylamide sulfonic acid | 2 |
| Methanol | 50 |
| Ion-exchange water | 4 |

The above polymerized liquid containing the dispersed polymer particles is hereinafter referred to as slurry A.

The same dye and quenchers as those employed in Example 1 with the formulation as shown in TABLE 8 were mixed with 20 parts by weight of methanol and 5 parts by weight of ion-exchange water. To this mixture, 150 parts by weight of slurry A were added, and the mixture was stirred at 50° C. for 5 hours.

This reaction mixture was then cooled to room temperature and centrifuged. With the supernatant removed, the dispersion was dispersed again in a mixed solvent of 50 parts by weight of methanol and 50 parts by weight of ion-exchange water to wash the dispersed polymer particles. The dispersed polymer particles were washed three times by the above-mentioned redispersion.

The thus obtained polymer particles were filtered and dried, and then dried under reduced pressure for 6 hours, whereby a yellow toner No. 2, a magenta toner No. 2, a cyan toner No. 2 and a black toner No. 2 for electrostatic development of the present invention were prepared.

TABLE 8

| | Example 1 | | | |
|---|---|---|---|---|
| | Yellow Toner | Magenta Toner | Cyan Toner | Black Toner |
| Slurry A | 150 | 150 | 150 | 150 |
| Yellow dye | 1 | — | — | — |
| Magenta dye | — | 0.5 | — | — |
| Cyan dye | — | — | 0.3 | — |
| Black dye | — | — | — | 1 |
| β-carotene | 0.3 | 0.3 | 0.3 | 0.3 |
| DABCO | 0.3 | 0.3 | 0.3 | 0.3 |

Comparative Example 3

The procedure for preparation of the yellow toner No. 2, the magenta toner No. 2, the cyan toner No. 2, and the black toner No. 2 prepared in Example 2 was repeated except that the quenchers, β-carotene and DABCO, added to the slurry A in Example 2, were replaced by 0.6 parts by weight of 2,5-dioctylhydroquinone serving as an anti-oxidizing agent, whereby a comparative yellow toner No. 3, a comparative magenta toner No. 3, a comparative cyan toner No. 3 and a comparative black toner No. 3 were prepared.

Comparative Example 4

The procedure for preparation of the yellow toner No. 2, the magenta toner No. 2, the cyan toner No. 2, and the black toner No. 2 prepared in Example 2 was repeated except that the quenchers, β-carotene and DABCO, added to the slurry A in Example 2, were not added to the slurry A, whereby a comparative yellow toner No. 4, a comparative magenta toner No. 4, a comparative cyan toner No. 4 and a comparative black toner No. 4 were prepared.

TABLE 9 shows the results of the fading ratios of color images made by the respective color toners prepared in Example 2 and Comparative Examples 3 and 4.

The results shown in TABLE 9 indicate that the fading ratio of fixed image samples prepared by toners in Comparative Example 4, which contained neither the quenchers nor the anti-oxidizing agent, was largest, and that the anti-fading performance of the toners prepared in Comparative Example 3, which contained the anti-oxidizing agent, was slightly better than that of the toners prepared in Comparative Example 4, but the anti-fading performance of the toners prepared in Example 2, which contained the quenchers, was much better than any of the anti-fading performances of the toners prepared in Comparative Examples 3 and 4.

TABLE 9

| | Fading Ratio (%) of Fixed Image Sample | | | |
|---|---|---|---|---|
| | Yellow Toner | Magenta Toner | Cyan Toner | Black Toner |
| Ex. 2 | 38 | 30 | 43 | 25 |
| Comp. Ex. 3 | 45 | 64 | 72 | 50 |
| Comp. Ex. 4 | 62 | 69 | 88 | 62 |

EXAMPLE 3

The procedure for preparation of the cyan toner No. 1 prepared in Example 1 was repeated except that the quenchers, β-carotene and DABCO, employed in the cyan toner No. 1, were replaced by 1 part by weight of nickel p-toluenesulfonate serving as a quencher, whereby a cyan toner No. 3 was prepared.

By use of this cyan toner No. 3, cyan images were made, and the fading ratio of the cyan images was measured. The result was that the fading ratio was 20%, indicating that the anti-fading performance of this toner was improved in comparison with the cyan toner No. 2 prepared in Example 2.

EXAMPLE 4

The procedure for preparation of the cyan toner No. 2 prepared in Example 2 was repeated except that the quenchers, β-carotene and DABCO, employed in the cyan toner No. 2, were replaced by 0.5 parts by weight of nickel p-toluenesulfonate serving as a quencher, whereby a cyan toner No. 4 was prepared.

Cyan images were made by use of the above toner, and the fading ratio thereof was 21%, which indicates that the anti-fading performance of the toner was better than the anti-fading performance of the cyan toner No. 2 prepared in Example 2.

EXAMPLE 5

The procedure for preparation of the cyan toner No. 4, prepared in Example 4 was repeated except that the dye employed in the cyan toner No. 4 was replaced by indoaniline dyes 1 to 3 shown in the following TABLE 10, in the same amount as that of the dye employed in the cyan toner No. 4, and the quencher employed in Example 4 was replaced by 2 parts by weight of Compound (Q-52) shown in TABLE 2, whereby color toners No. 5-1, No. 5-2 and No. 5-3 were prepared:

TABLE 10

Dye 1

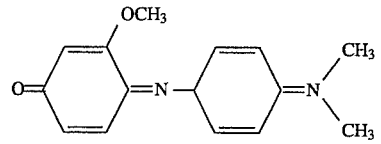

Dye 2

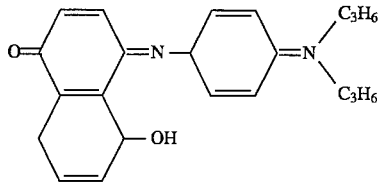

Dye 3

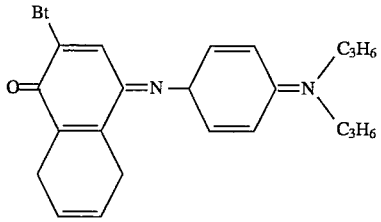

Color images were made by use of the above toners, and the fading ratios thereof were measured. The results are shown in TABLE 11.

Comparative Example 5

The procedure for preparation of one of the color toners No. 5-1, No. 5-2 and No. 5-3 was repeated except that the indoaniline dye employed therein was replaced by a commercially available azo dye (Trademark "KAYOLON Br. BLUE FRS" made by Nippon Kayaku Co., Ltd.), whereby a comparative color toner No. 5 was prepared.

A color image was made by use of this comparative color toner No. 5, and the fading ratio thereof was measured. The result is shown in the following TABLE 11:

TABLE 11

| Evaluated | Fading Ratio (%) of Image Samples | | | |
|---|---|---|---|---|
| | Indoaniline Dye in Example 5 | | | Comp. Ex. 5 |
| Samples | Dye 1 | Dye 2 | Dye 3 | Azo Dye |
| Fixed Image Samples | 10 | 12 | 11 | 27 |

The results shown in TABLE 11 indicate that a sufficient anti-fading performance was obtained when the compound (Q-52) was employed as a quencher, and that the anti-fading performance was further improved when the indoaniline dyes were employed.

EXAMPLE 6

The procedure for preparation of the comparative yellow toner No. 4, the comparative magenta toner No. 4, the comparative cyan toner No. 4 and the comparative black toner No. 4 prepared in Comparative Example 4 was repeated except that 0.5 parts by weight of DABCO and 0.5 parts by weight of β-carotene were added to 100 parts by weight of each of the above toners, whereby a yellow toner No. 6, a magenta toner No. 6, a cyan toner No. 6, and a black toner No. 6 of the present invention were prepared.

By use of these toners, color images were made end the fading ratios thereof were measured. The results are shown in TABLE 12.

Comparative Example 6

The procedure for preparation of the yellow toner No. 6, the magenta toner No. 6, the cyan toner No. 6 and the black toner No. 6 prepared in Example 6 was repeated except that 0.5 parts by weight of DABCO and 0.5 parts by weight of β-carotene added to 100 parts by weight of each of the above toners in Example 6 were replaced by 0.5 parts by weight of 4-phenylbenzophenone serving as an ultraviolet absorbing agent, and 0.5 parts by weight of 2,5-dioctylhydroquinone serving as an anti-oxidizing agent, whereby a comparative yellow toner No. 6, a comparative magenta toner No. 6, a comparative cyan toner No. 6, and a comparative black toner No. 6 were prepared.

By use of these comparative toners, color images were made and the fading ratios thereof were measured. The results are shown in the following TABLE 12:

TABLE 12

| | Fading Ratio (%) of Fixed Image Samples | | | |
|---|---|---|---|---|
| | Yellow Toner | Magenta Toner | Cyan Toner | Black Toner |
| Ex. 6 | 41 | 35 | 47 | 31 |
| Comp. Ex. 6 | 55 | 56 | 65 | 51 |
| Comp. Ex. 4 | 62 | 69 | 88 | 62 |

The results shown in TABLE 12 indicate that the color images developed by the toners containing therein the ultraviolet absorbing agent and the anti-oxidizing agent exhibit some anti-fading performance in comparison with the color images developed by the toners free from the ultraviolet absorbing agent and the anti-oxidizing agent.

Furthermore, the color images developed by the toners containing therein DABCO and β-carotene as quenchers exhibited further improved anti-fading performance.

EXAMPLE 7

The procedure for preparation of the cyan toner No. 6 prepared in Example 6 was repeated except that the quenchers employed in Example 6 were replaced by the quencher (Q-52) with the addition of 1 part of the quencher (Q-52) to 100 parts by weight of the cyan toner, whereby a cyan toner No. 7 of the present invention was prepared.

A color image was made by this cyan toner No. 7 and the fading ratio of the color image was measured. The result was that the fading ratio was 31%, indicating that the anti-fading performance thereof was better than that of the cyan toner No. 6 prepared in Example 6.

EXAMPLE 8

The comparative yellow toner No. 4, the comparative magenta toner No. 4, the comparative cyan toner No. 4 and the comparative black toner No. 4 prepared in Comparative Example 4 were incorporated in a commercially available color copying machine (Trademark "ARTAGE 8000 REALA" made by Ricoh Company, Ltd.).

3 parts by weight of the quencher (Q-52) were added to 100 parts by weight of silicone oil for offset prevention, whereby an offset preventing silicone oil composition was prepared.

By use of this offset preventing silicone oil composition in a thermal image fixing unit of the above color copying machine, color-image-fixed copy samples were prepared.

Comparative Example 7

The procedure for making color-image fixed copy samples in Example 8 was repeated except that the quencher (Q-52) employed in Example 8 was replaced by 4-phenylbenzophenone serving as an ultraviolet absorbing agent, whereby comparative color-image-fixed copy samples were prepared.

The fading ratio of the color images formed in Example 8 was 37%, while the fading ratio of the color images formed in Comparative Example 7 was 54%. This indicates that the anti-fading effect can be obtained by applying the quencher on the fixed color images.

EXAMPLE 9

A mixture of 100 parts by weight of polyester resin (Tg: 58° C., softening point: 68° C.), 1 part by weight of C.I. Disperse Blue 165, 2 parts by weight of Compound Q-23 shown in TABLE 4, and 4 parts by weight of zinc 3,5-di-tert-butyl salicylate was kneaded with the application of heat thereto by use of heat rollers. The kneaded mixture was cooled, crushed and classified, whereby finely-divided, cyan-colored particles with a volume mean diameter of 8.5 μm were obtained.

0.5 parts by weight of silica were added to 100 parts by weight of the above obtained cyan-colored particles, whereby a cyan toner with the silica being deposited on the surface of the toner particles was prepared.

3 parts by weight of the thus prepared cyan toner were mixed with 100 parts by weight of an iron carrier, whereby a two-component developer was prepared.

With the thus prepared two-component developer being incorporated in a magnetic brush development unit of a digital electrophotographic copying machine comprising an organic photoconductor, copies were made. As a result, copies with clear cyan images were obtained.

The fading ratio of the color images transferred to a polyester film was 39%.

EXAMPLE 10

The procedure for preparation of the cyan toner No. 9 in Example 9 was repeated except that 1 part by weight of C.I. Disperse Blue 165 employed in Example 9 was replaced by 2 parts by weight of C.I. Disperse Red 145, and 2 parts by weight of Compound Q-23 employed in Example 9 were replaced by 1 part by weight of Compound Q-26 shown in TABLE 4, whereby a magenta toner No. 10 was prepared.

3 parts by weight of the thus prepared magenta toner No. 10 were mixed with 100 parts by weight of an iron carrier, whereby a two-component developer was prepared.

With the thus prepared two-component developer being incorporated in the same digital electrophotographic copying machine as employed in Example 9, copies were made.

As a result, copies with clear magenta images with excellent dot reproduction were obtained.

The fading ratio of the magenta images transferred to a polyester film was 28%.

EXAMPLE 11

The procedure for preparation of the magenta toner in Example 10 was repeated except that 2 parts by weight of C.I. Disperse Red 145 employed in Example 10 were replaced by 3 parts by weight of C.I. Disperse Yellow 62, and 1 part by weight of Compound Q-26 employed in Example 10 was replaced by 1 part by weight of Compound Q-27 shown in TABLE 4, whereby a yellow toner No. 11 was prepared.

3 parts by weight of the thus prepared yellow toner No. 11 were mixed with 100 parts by weight of an iron carrier, whereby a two-component developer was prepared, With the thus prepared two-component developer being incorporated in the same digital electrophotographic copying machine as employed in Example 9, copies were made. As a result, copies with clear yellow images were obtained.

The fading ratio of the yellow images transferred to a polyester film was 34%.

The above obtained yellow images were projected on a screen by an overhead projector (OHP). As a result, clear yellow projected images were obtained.

EXAMPLE 12

The procedure for preparation of the magenta toner No. 10 in Example 10 was repeated except that 1 part by weight of Compound Q-26 employed in Example 10 was replaced by 1 part by weight of Compound Q-30 shown in TABLE 4, whereby a magenta toner No. 12 was prepared.

3 parts by weight of the thus prepared magenta toner No. 12 were mixed with 100 parts by weight of an iron carrier, whereby a two-component developer was prepared.

With the thus prepared two-component developer being incorporated in the same digital electrophotographic copying machine as employed in Example 9, copies were made. As a result, copies with clear magenta images were obtained.

The fading ratio of the magenta images transferred to a polyester film was 37%.

EXAMPLE 13

The procedure for preparation of the magenta toner No. 10 in Example 10 was repeated except that 1 part by weight of Compound Q-26 employed in Example 10 was replaced by 1 part by weight of Compound Q-51 shown in TABLE 4, whereby a magenta toner No. 13 was prepared.

3 parts by weight of the thus prepared magenta toner No. 13 were mixed with 100 parts by weight of an iron carrier, whereby a two-component developer was prepared.

With the thus prepared two-component developer being incorporated in the same digital electrophotographic copying machine as employed in Example 9, copies were made. As a result, copies with clear magenta images were obtained.

The fading ratio of the magenta images transferred to a polyester film was 33%.

Comparative Example 8

The procedure for preparation of the magenta toner in Example 12 was repeated except that 1 part by weight of Compound Q-30 employed in Example 12 was not employed, whereby a comparative magenta toner No. 8 was prepared.

3 parts by weight of the thus prepared comparative magenta toner No. 8 were mixed with 100 parts by weight of an iron carrier, whereby a two-component developer was prepared.

With the thus prepared two-component developer being incorporated in the same digital electrophotographic copying machine as employed in Example 9, copies were made. As a result, copies with magenta images were obtained.

Japanese Patent Application No. 5-297448 filed on Nov. 2, 1993 and Japanese Patent Application filed on Oct. 24, 1994 (Application No. is not yet available) are hereby incorporated by reference.

What is claimed is:

1. An image formation material comprising a binder resin, a dye, and a singlet oxygen.

2. The image formation material as claimed in claim 1, wherein said quencher is selected from the group consisting of compounds of formulae (I) to (IV):

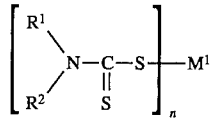

(I)

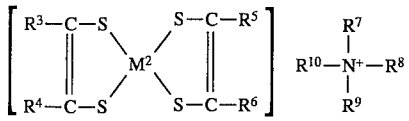

(II)

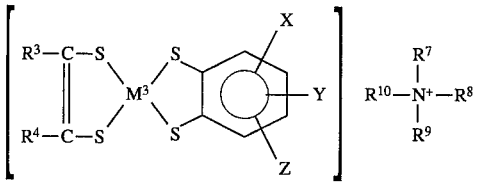

(III)

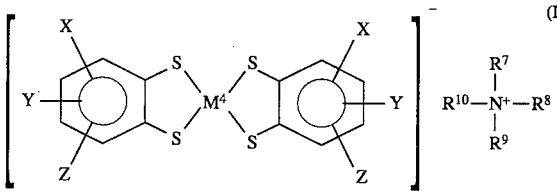

(IV)

wherein $R^1$ and $R^2$ each is independently an alkyl group having 1 to 18 carbon atoms, phenyl group, benzyl group or an aryl group; $M^1$ is a bivalent or trivalent metal; n is an integer of 2 or 3; $R^3$, $R^4$, $R^5$, and $R^6$ each is independently cyano group, phenyl group, or a phenyl group substituted with an alkyl group, an alkoxyl group, or a halogen atom; X, Y and Z each is independently an alkyl group having 1 to 4 carbon atoms, a halogen atom, a hydrogen atom, or an alkoxyl group; $R^7$, $R^8$, $R^9$, and $R^{10}$ each is an alkyl group having 1 to 18 carbon atoms; and $M^2$, $M^3$ and $M^4$ each is independently nickel, copper, cobalt, palladium or vanadium.

3. The image formation material as claimed in claim 2, wherein each of $M^1$ to $M^4$ is nickel.

4. An image fading prevention method comprising the step of coating a quencher on the surface of images formed by an image formation material which comprises a binder resin and a dye.

5. The image fading prevention method as claimed in claim 4, wherein said quencher is selected from the group consisting of compounds of formulae (I) to (IV):

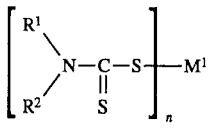

(I)

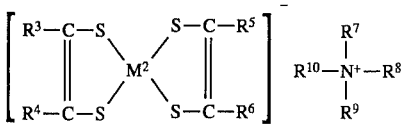

(II)

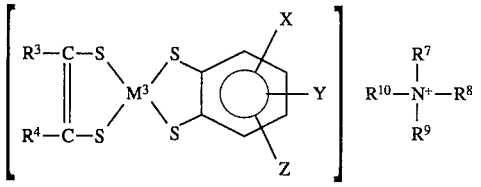

(III)

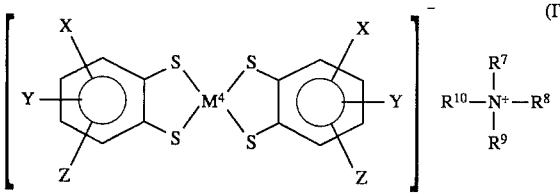

(IV)

wherein $R^1$ and $R^2$ each is independently an alkyl group having 1 to 18 carbon atoms, phenyl group, benzyl group or an aryl group $M^1$ is a bivalent or trivalent metal; n is an integer of 2 or 3; $R^3$, $R^4$, $R^5$, and $R^6$ each is independently cyano group, phenyl group, or a phenyl group substituted with an alkyl group, an alkoxyl group, or a halogen atom; X, Y and Z each is independently an alkyl group having 1 to 4 carbon atoms, a halogen atom, a hydrogen atom, or an alkoxyl group; $R^7$, $R^8$, $R^9$, and $R^{10}$ each is an alkyl group having 1 to 18 carbon atoms; and $M^2$, $M^3$ and $M^4$ each is independently nickel, copper, cobalt, palladium or vanadium.

6. The image fading prevention method as claimed in claim 4, wherein said quencher is a compound of formula

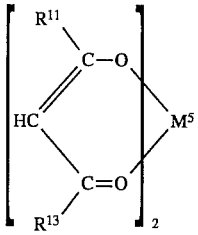

(V)

wherein $M^5$ is selected from the group consisting of nickel, copper, cobalt, palladium and vanadium; and $R^{11}$ and $R^{12}$ each is independently a lower alkyl group or $—C(R^{13})_3$, in which $R^{13}$ is a halogen atom.

7. The image fading prevention method as claimed in claim 5, wherein each of $M^1$ to $M^4$ is nickel.

8. The image fading prevention method as claimed in claim 6, wherein $M^5$ is nickel.

* * * * *